US006589596B2

(12) United States Patent
Takekuma et al.

(10) Patent No.: US 6,589,596 B2
(45) Date of Patent: Jul. 8, 2003

(54) METHOD FOR COATING A RUNNING WEB USING A COATING ROD

(75) Inventors: Hideaki Takekuma, Odawara (JP); Mikio Tomaru, Odawara (JP); Toshihiro Mandai, Odawara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/938,502

(22) Filed: Aug. 27, 2001

(65) Prior Publication Data

US 2002/0043210 A1 Apr. 18, 2002

(30) Foreign Application Priority Data

Aug. 25, 2000 (JP) ..... 2000-255129
Aug. 25, 2000 (JP) ..... 2000-255626

(51) Int. Cl.[7] ..... B05D 3/12

(52) U.S. Cl. ..... 427/172; 427/359; 427/361; 118/118; 118/414

(58) Field of Search ..... 427/359, 361, 427/172; 118/110, 112, 118, 414

(56) References Cited

U.S. PATENT DOCUMENTS 5,108,795 A * 4/1992 Shibata et al. ..... 427/356
5,306,523 A * 4/1994 Shibata ..... 427/129
5,419,509 A * 5/1995 Krayenhagen ..... 242/419

* cited by examiner

*Primary Examiner*—Katherine A. Bareford
(74) *Attorney, Agent, or Firm*—Sughrue Mion, PLLC

(57) ABSTRACT

Thickness unevenness of a coating liquid layer in a width direction of a web is adjusted by moving a guide roller at the proximity of a coating rod so as to deliberately provide tension variation in the width direction of the web in purpose of forming the coating liquid layer with a desired thickness on the web by the coating rod.

6 Claims, 10 Drawing Sheets

FIG. 8

| | COATING SPEED (m/min.) | TENSION (kgf/m) | ANGLE OF INCLINATION FROM HORIZONTAL POSITION OF ROLL (DEGREE) | ANGLE OF WINDING ON ROLL (DEGREE) | THICKNESS VARIATION IN WIDTH DIRECTION OF WEB (%) | BASE RUNNING POSITION |
|---|---|---|---|---|---|---|
| EXAMPLE-1 | 300 | 8 | 0 | 15 | +5 | Good |
| EXAMPLE-2 | 300 | 8 | 0.5 | 15 | +2 | Fair |
| EXAMPLE-3 | 300 | 8 | 0 | 45 | +5 | Good |
| EXAMPLE-4 | 300 | 8 | 0.5 | 45 | 0 | Fair |
| EXAMPLE-5 | 300 | 8 | 0 | 90 | +5 | Good |
| EXAMPLE-6 | 300 | 8 | 0.2 | 90 | +0 | Fair |
| COMPARATIVE EX.-1 | 300 | 8 | 0.5 | 12 | +3 | Poor |
| COMPARATIVE EX.-2 | 300 | 8 | 0.7 | 12 | −1 | Poor |
| COMPARATIVE EX.-3 | 300 | 8 | 0.5 | 5 | +4 | Poor |

FIG. 9

| | COATING SPEED (m/min.) | TENSION (kgf/m) | ANGLE OF INCLINATION FROM HORIZONTAL POSITION OF ROLL (DEGREE) | ANGLE OF WINDING ON ROLL (DEGREE) | THICKNESS VARIATION IN WIDTH DIRECTION OF WEB (%) | BASE RUNNING POSITION |
|---|---|---|---|---|---|---|
| EXAMPLE-7 | 300 | 8 | 0 | 15 | +10 | Good |
| EXAMPLE-8 | 300 | 8 | 0.05 | 15 | +8 | Good |
| EXAMPLE-9 | 300 | 8 | 0.1 | 15 | +7 | Good |
| EXAMPLE-10 | 300 | 8 | 0.5 | 15 | +2 | Fair |
| EXAMPLE-11 | 300 | 8 | 0 | 45 | +10 | Good |
| EXAMPLE-12 | 300 | 8 | 0.05 | 45 | +5 | Good |
| EXAMPLE-13 | 300 | 8 | 0.1 | 45 | +3 | Good |
| EXAMPLE-14 | 300 | 8 | 0.5 | 45 | 0 | Good |
| EXAMPLE-15 | 300 | 8 | 0.7 | 45 | −2 | Good |
| EXAMPLE-16 | 300 | 8 | 1.0 | 45 | −10 | Fair |
| EXAMPLE-17 | 300 | 8 | 0 | 90 | +10 | Good |
| EXAMPLE-18 | 300 | 8 | 0.05 | 90 | +2 | Good |
| EXAMPLE-19 | 300 | 8 | 0.1 | 90 | 0 | Good |
| EXAMPLE-20 | 300 | 8 | 0.2 | 90 | −10 | Good |
| EXAMPLE-21 | 300 | 8 | 0 | 12 | 0 | Good |
| EXAMPLE-22 | 300 | 6 | 0.5 | 45 | 0 | Good |
| EXAMPLE-23 | 300 | 15 | 0.5 | 45 | 0 | Good |
| EXAMPLE-24 | 100 | 8 | 0.5 | 45 | 0 | Good |
| EXAMPLE-25 | 800 | 8 | 0.5 | 45 | 0 | Good |
| COMPARATIVE EX.-4 | 300 | 8 | 0.5 | 12 | +3 | Poor |
| COMPARATIVE EX.-5 | 300 | 8 | 0.7 | 12 | 0 | Poor |
| COMPARATIVE EX.-6 | 300 | 8 | 0.5 | 10 | +3 | Poor |
| COMPARATIVE EX.-7 | 300 | 8 | 0.7 | 10 | +1 | Poor |

FIG. 10

| | COATING SPEED (m/min.) | TENSION (kgf/m) | ANGLE OF INCLINATION FROM HORIZONTAL POSITION OF ROLL (DEGREE) | ANGLE OF WINDING ON ROLL (DEGREE) | THICKNESS VARIATION IN WIDTH DIRECTION OF WEB (%) | BASE RUNNING POSITION |
|---|---|---|---|---|---|---|
| EXAMPLE-26 | 300 | 8 | 1.0 | 15 | +10 | Fair |
| EXAMPLE-27 | 300 | 8 | 1.0 | 45 | +3 | Good |
| EXAMPLE-28 | 300 | 8 | 1.0 | 90 | −7 | Good |
| EXAMPLE-29 | 300 | 6 | 1.0 | 45 | +3 | Good |
| EXAMPLE-30 | 300 | 15 | 1.0 | 45 | +3 | Good |
| EXAMPLE-31 | 100 | 8 | 1.0 | 45 | +3 | Good |
| EXAMPLE-32 | 800 | 8 | 1.0 | 45 | +3 | Good |
| COMPARATIVE EX.-8 | 300 | 8 | 0 | 10 | +20 | Good |
| COMPARATIVE EX.-9 | 300 | 8 | 0.05 | 10 | +17 | Good |
| COMPARATIVE EX.-10 | 300 | 8 | 0.1 | 10 | +16 | Good |
| COMPARATIVE EX.-11 | 300 | 8 | 0.5 | 10 | +15 | Fair |
| COMPARATIVE EX.-12 | 300 | 8 | 0 | 8 | +20 | Good |
| COMPARATIVE EX.-13 | 300 | 8 | 0.05 | 8 | +18 | Good |
| COMPARATIVE EX.-14 | 300 | 8 | 0.1 | 8 | +17 | Good |
| COMPARATIVE EX.-15 | 300 | 8 | 1.0 | 10 | +10 | Poor |
| COMPARATIVE EX.-16 | 300 | 8 | 1.5 | 10 | +5 | Poor |
| COMPARATIVE EX.-17 | 300 | 8 | 1.5 | 8 | +8 | Poor |
| COMPARATIVE EX.-18 | 300 | 8 | 2.0 | 8 | +5 | Poor |

METHOD FOR COATING A RUNNING WEB USING A COATING ROD

BACKGROUND OF THE INVENTION

1. Field of the Invention

The present invention relates to a rod coating method and apparatus, specifically those in which a web is coated with a coating liquid as a medium for recording images and data such as a magnetic tape, a photo film and printing paper with a coating rod.

2. Description of the Related Art

Methods for forming a coating liquid layer with a desired thickness on a web are a rod coating method (also called a bar coating method), a reverse roll coating method, a gravure coating method, an extrusion coating method, and so forth. The rod coating method is widely used because an apparatus is simple and it can form a thin layer.

The rod coating method is roughly divided into two types. In one type, a coating rod comes into contact with a running web to coat the web with a coating liquid and adjust the amount of the coating liquid. In the other type, a precoating apparatus coats a web with an excessive amount of a coating liquid, and a coating rod comes into contact with the web to adjust the amount of the coating liquid by removing the excess.

The coating rod is a wired coating rod with a wire on its surface, a grooved coating rod with grooves on its surface, or a flat coating rod without the wire and the grooves. The wired coating rod or the grooved coating rod in which a thickness of the coating liquid layer is determined according to a diameter of the wire or a depth of the grooves is generally used; however, those rods are not resistant to abrasion. The flat coating rod is resistant to abrasion since it can be made of an extremely hard metal and there is the coating liquid between the surface of the rod and the web.

Yet, in the rod coating method, the thickness of the layer has a large unevenness along the width of the web as compared with that in the extrusion coating method (the thickness can be adjusted by a slit or the like) since the coating rod does not have a thickness adjusting function. In particular, if the flat coating rod is used, it is difficult to coat the web with a layer thickness unevenness within a regulated range in the width direction of the web because the thickness unevenness of the coating liquid layer in the width direction of the web is easily affected by a thickness unevenness of the web in the width direction of the web itself.

Moreover, the surface of the flat coating rod is close to the web compared with those of the wired coating rod and the grooved coating rod; thus foreign matters are easily caught on the surface of the rod to cause streaks on the layer.

SUMMARY OF THE INVENTION

The present invention has been developed in view of the above-described circumstances, and has as its object the provision of a rod coating method and apparatus in which a web can be easily coated with a small thickness unevenness of a coating liquid layer in a width direction of the web.

The present invention has been developed in view of the above-described circumstances, and has as its object also the provision of a rod coating method and apparatus in which foreign matters can not be easily caught on a surface of a flat coating rod not to cause streaks on a coating liquid layer.

In order to achieve the above-described objects, the present invention is directed to a rod coating method for forming, with a coating rod, a coating liquid layer on a running web tensioned by a plurality of guide rollers, wherein: the coating rod applies a coating liquid on the web and adjusts an amount of the coating liquid on the web; and the web has a tension variation in a width direction of the web to adjust a thickness unevenness of the coating liquid layer in the width direction of the web.

Moreover, in order to achieve the above-described objects, the present invention is directed to a rod coating method for forming, with a coating rod, a coating liquid layer on a running web tensioned by a plurality of guide rollers, wherein: a precoating apparatus excessively applies a coating liquid on the web and the coating rod adjusts an amount of the coating liquid on the web by removing an excess of the coating liquid on the web; and the web has a tension variation in a width direction of the web to adjust a thickness unevenness of the coating liquid layer in the width direction of the web.

Moreover, in order to achieve the above-described objects, the present invention is directed to a rod coating apparatus for forming, with a coating rod, a coating liquid layer on a running web tensioned by a plurality of guide rollers, comprising: the coating rod which applies a coating liquid on the web and adjusts an amount of the coating liquid on the web; and a moving device which moves at least one of the plurality of guide rollers adjacent to the coating rod.

Moreover, in order to achieve the above-described objects, the present invention is directed to a rod coating apparatus for forming, with a coating rod, a coating liquid layer on a running web tensioned by a plurality of guide rollers, comprising: the coating rod which adjusts an amount of a coating liquid on the web by removing an excess of the coating liquid on the web, the coating liquid having been excessively applied on the web by a precoating apparatus; and a moving device which moves at least one of the plurality of guide rollers adjacent to the coating rod.

In the present invention, the guide roller adjacent to the coating rod is moved to give the tension variation to the web in the width direction of the web. This adjusts the thickness unevenness of the coating liquid layer in the width direction of the web. Therefore, the thickness unevenness of the coating liquid layer in the width direction of the web can be easily reduced. This invention is particularly effective in case of a flat coating rod.

Furthermore, in order to achieve the above-described objects, the present invention is directed to a rod coating method for forming a coating liquid layer on a running web with a flat coating rod, wherein: the flat coating rod applies a coating liquid on the web and adjusts an amount of the coating liquid on the web; and an inequality $R_{max} \leqq h/3$ is satisfied where h is a thickness of the coating liquid layer and $R_{max}$ is a maximum projection height of a surface of the flat coating rod.

Moreover, in order to achieve the above-described objects, the present invention is directed to a rod coating method for forming a coating liquid layer on a running web with a flat coating rod, wherein: a precoating apparatus excessively applies a coating liquid on the web and the flat coating rod adjusts an amount of the coating liquid on the web by removing an excess of the coating liquid on the web; and an inequality $R_{max} \leqq h/3$ is satisfied where h is a thickness of the coating liquid layer and $R_{max}$ is a maximum projection height of a surface of the flat coating rod.

Moreover, in order to achieve the above-described objects, the present invention is directed to a rod coating apparatus for forming a coating liquid layer on a running web with a flat coating rod, wherein: the flat coating rod applies a coating liquid on the web and adjusts an amount of the coating liquid on the web; and a surface of the flat coating rod is smoothed so that an inequality $R_{max} \leqq h/3$ is satisfied where h is a thickness of the coating liquid layer and $R_{max}$ is a maximum projection height of a surface of the flat coating rod.

Moreover, in order to achieve the above-described objects, the present invention is directed to a rod coating apparatus for forming a coating liquid layer on a running web with a flat coating rod, wherein: the flat coating rod adjusts an amount of a coating liquid on the web by removing an excess of the coating liquid on the web, the coating liquid having been excessively applied on the web by a precoating apparatus; and a surface of the flat coating rod is smoothed so that an inequality $R_{max} \leqq h/3$ is satisfied where h is a thickness of the coating liquid layer and $R_{max}$ is a maximum projection height of a surface of the flat coating rod.

In the present invention, the following inequality is satisfied when the thickness of the coating liquid layer is h and the maximum projection height of the surface of the coating rod is $R_{max}$, $R_{max} \leqq h/3$. Therefore, foreign matters can not be easily caught on the surface of the coating rod.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 8 is an explanatory view for an embodiment performed by the rod coating apparatus of the present invention with which application and measurement are performed separately, the rod coating apparatus using a wired rod and a web with large thickness unevenness;

FIG. 9 is an explanatory view for an embodiment performed by the rod coating apparatus of the present invention with which application and measurement are performed separately, the rod coating apparatus using a flat rod and a web with small thickness unevenness; and FIG. 10 is an explanatory view for an embodiment performed by the rod coating apparatus of the present invention with which application and measurement are performed separately, the rod coating apparatus using a flat rod and a web with large thickness unevenness.

DETAILED DESCRIPTION OF THE PREFERRED EMBODIMENTS

Hereunder preferred embodiments for a rod coating method and apparatus of the present invention will be described in detail in accordance with the accompanying drawings.

Figure 1:
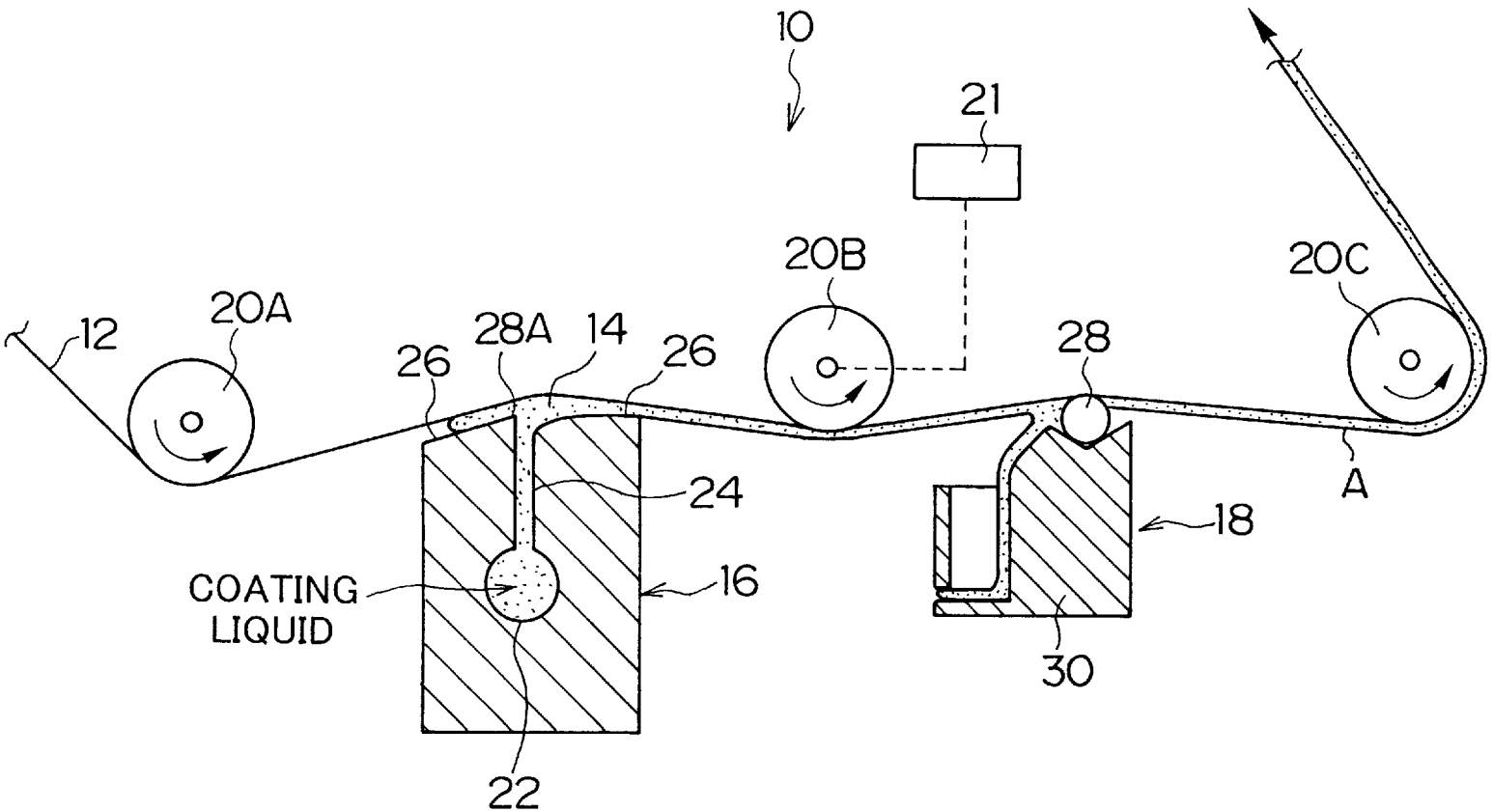
FIG. 1 is a view showing an entire structure of a rod coating apparatus of the present invention with which application and measurement are performed separately.

FIG. 1 is a view of an entire structure of a coating apparatus 10 of the present invention in a case of using a rod coating apparatus with which a coating liquid being excessively applied on a web by a precoating apparatus is removed so as to measure an amount of the coating liquid; that is, the application and measurement are performed separately.

The rod coating apparatus 10 comprises a precoating apparatus 16 of an extrusion type for applying a coating liquid 14 on a web 12 in an excessive amount than a desired amount of coating, a rod apparatus 18 for removing excess of the coating liquid 14 being excessively applied on the web 12, plural guide rollers 20A, 20B, and 20C provided along a web transporting passage, and movement apparatuses 21 for moving at least one guide roller positioned at the proximity of the coating rod apparatus 18. In the present embodiment, the movement apparatuses 21 are provided to the guide roller 20B positioned at a leading side of the web transporting direction in the coating rod apparatus 18.

The precoating apparatus 16 of an extrusion type continuously discharges the coating liquid 14 supplied to a pocket 22 by a pressure from an outlet 24A of a slot 24 connected with the pocket 22 while pressing a top end face 26 of a head on the web 12 which is hung from the guide rollers 20A, 20B, and 20C and runs at a constant speed in a direction of an arrow. Thereby, an excessive amount of coating liquid is applied on the bottom face of the web 12 just in front of the coating rod apparatus 18. As to the precoating apparatus 16, types of the apparatus is not limited to an extrusion type; any type of coating apparatus may be used which applies a coating liquid on the web 12.

The coating rod apparatus 18 is constructed in which a cylindrical coating rod 28 disposed by supporting it with a rod supporting member 30 so as to be parallel with a width direction of the web 12, which continuously runs with a tension provided in its running direction, and the web 12 comes in contact with the coating rod 28 with the guide rollers 20A, 20B, and 20C by a predetermined wrapping angle. Thus, excess of the coating liquid 14 applied excessively on the web 12 by the precoating apparatus 16 is removed with the coating rod 28 and is measured in a desired liquid amount, and a coating liquid layer A with a desired thickness is formed. In that case, the coating rod 28 connects to a rotation drive source (not shown) and rotates slowly in a direction which is reverse to the running direction of the web 12. Alternatively, the coating rod 28 comes in contact with the web 12 so as to rotate in the same direction as the running direction of the web; or even a coating rod which does not rotate may be used. Types of the coating rod 28 may be: a flat rod with a flat rod surface, a wired rod on which a wire is densely wound, a grooved rod which is grooved in a circumference of the surface of the rod material, and so forth. A diameter of the coating rod 28 is usually between 1 mm and 50 mm; but it is not precisely limited.

Figure 2:
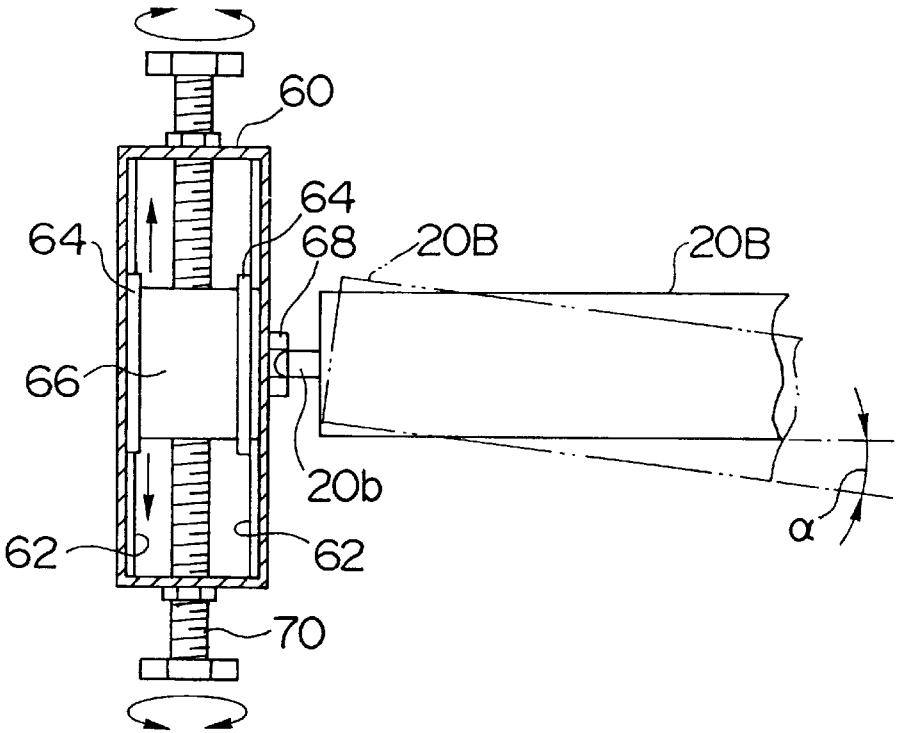
FIGS. 2(*a*) and 2(*b*) are views illustrating a system of a movement apparatus.
Figure 2:
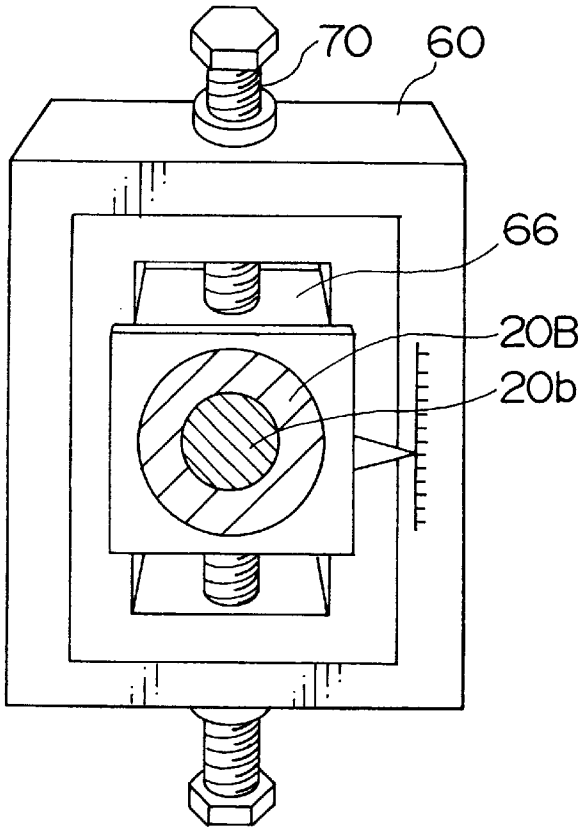

The movement apparatuses 21 are so designed as to provide tension variation in the width direction of the web 12. In FIGS. 2(*a*) and 2(*b*), only the movement apparatus 21 at one side of the guide roller 20B is shown, but the movement apparatuses 21 are provided at both sides of the guide roller 20B.

As seen from FIGS. 2(*a*) and 2(*b*), the movement apparatus 21 has a pair of rails 62 and 62, which are laid vertically within a longitudinal casing 60 which is securely supported with a support member (not shown), and a bearing 66 is slidably supported to the rails 62 via linear bearings 64 and 64. Moreover, the rotary shaft 20*b* of the guide roller 20B is supported to the bearing 66 via a free joint 68 and at the same time the bearing 66 is screwed to a feed screw 70 which is vertically inserted through the casing 60 along the rails 66. Rotating the feed screw 70 thereby moves the bearing 66 vertically within the casing 60. Thus, as seen from FIG. 1, when the guide roller 20B is moved downward, a winding angle of the web 12 to the guide roller 20B becomes wide, whereas the winding angle of the web 12 to the guide roller 20B becomes narrow when the guide roller 20B is moved upward. Further, as indicated by imaginary lines in FIG. 2(*a*), a direction of the axis of the guide roller 20B can be inclined by a predetermined angle $\alpha$ from its horizontal position by making a difference between amounts of sliding of the bearing 66 of the movement apparatuses 21 provided at both sides of the guide roller 20B so as to make a difference between height positions of the rotary shaft 20*b* at both sides of the guide roller 20B.

The typical web 12 are ones with between 0.3 m and 5 m in width, 45 m and 20000 m in length, and 2 $\mu$m–200 $\mu$m in thickness, and the web 12 includes a plastic film which is made of polyethylene terephthalate (PET), polyethylene-2, 6-naphthalate, cellulose diacetate, cellulose triacetate, cellulose acetate propionate, polyvinyl chloride, polyvinylidene chloride, polycarbonate, polyimide, polyamide, and so forth, or simply paper, or paper and similar material which is coated or laminated with $\alpha$-polyolefin in carbon numbers 2–10 such as polyethylene, polypropylene, and ethylene-butylene copolymer; alternatively, a web may be one on which a coating layer is formed as the base material.

The coating liquid 14 is not limited to non-Newtonian fluid such as a coating liquid for a magnetic tape; the coating liquid may be Newtonian fluid composed with a binder of gelatin solution for a photosensitive layer which is relatively low in viscosity.

The web 12 on which the coating liquid 14 is applied is cut in a required width from a wide original roll; however, tension is applied in the running direction of the web and a slight warp may occur in a width direction of the running web 12 since winding forces of the original roll at both ends and at the center differ. Moreover, in some types of the web 12 with elasticity, thickness unevenness which is inclined to the width direction of the web 12 may occur. In a case where such a warp or thickness unevenness of the web 12 is present, liquid pressures of the coating liquid 14 vary which is between the coating rod 28 and the web 12 at the time of removing the excess of the coating liquid. In short, liquid pressures of the coating liquid 14 vary in which a liquid pressure of one side is high while the counterpart of the other side is low in the width direction of the web 12. As a result, a part where the liquid pressure is high is removed by a large amount and thus a thickness of the coating liquid layer A on the web 12 becomes thin, while a part where the liquid pressure is low is removed by a small amount and thus a thickness of the coating liquid layer A on the web 12 becomes thick; hence the thickness distribution inclining to the width direction of the web occurs on the coating liquid layer A. However, the coating rod 28 itself does not have a function to adjust the thickness unevenness of the coating liquid layer A in the width direction, so the thickness unevenness in the width direction of the web tends to have a low quality as compared with an extrusion coating method.

The inventors of the present invention discussed on the above-described problem in order to solve it by the rod coating method. They have discovered that, even though the coating rod 28 itself does not have a function to adjust the thickness unevenness of the coating liquid layer A in the width direction of the web, the thickness unevenness of the coating liquid layer A in the width direction of the web can be adjusted by removing the excess of the coating liquid with the coating rod 28, because a liquid pressure of the coating liquid 14 existing between the coating rod 28 and the web 12 is balanced with a tension which is applied to the running direction of the web 12.

Moreover, in order to adjust the thickness unevenness of the coating liquid layer A in the width direction of the web by the tension variation, a problem occurs in that the running position of the web 12 is moved from the normal running position and leans to the end of the coating rod 28 since the guide roller 20B itself does not have a grip force to grip the web 12. However, the inventors of the present invention have also discovered that such problem can be avoided by setting the winding angle of the web 12 on the guide roller 20B to be 15 degrees.

Figure 3:
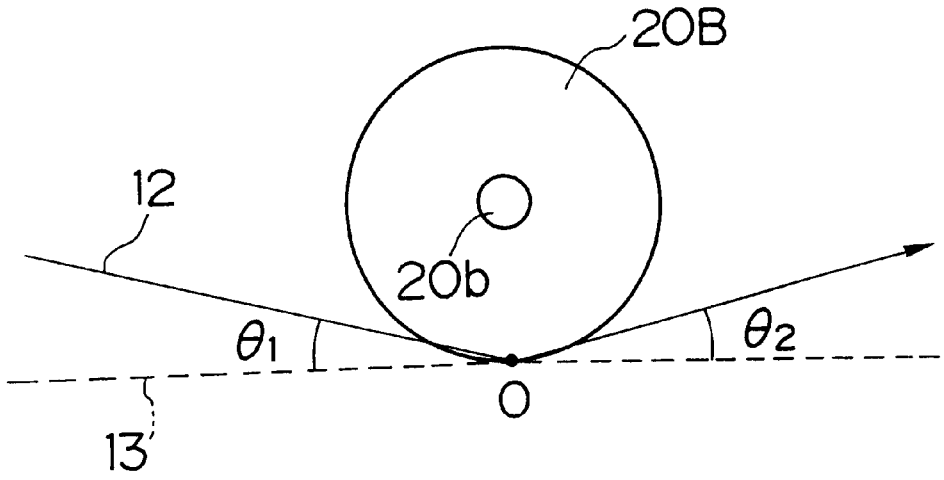
FIG. 3 is a view illustrating a winding angle.

As indicated in FIG. 3, the winding angle is a sum of an angle $\theta_1$, which is formed between the web 12 before contacting with the guide roller 20B and the horizontal tangent 13 of the guide roller 20B, and an angle $\theta_2$, which is formed between the web 12 after contacting with the guide roller 20B and the horizontal tangent 13 of the guide roller 20B.

The present invention is accomplished in view of the above-described knowledge, and has achieved that the guide roller 20B at the proximity of the coating rod 28 is moved so as to deliberately make tension variation in the width direction of the web 12 in order to form the coating liquid layer A in a desired thickness on the web 12, whereby the thickness unevenness of the coating liquid layer A in the width direction of the web which is formed by the coating rod 28 can be adjusted.

Accordingly, in the movement apparatus 21 of the rod coating apparatus 10 constructed as described above, first the rotation amounts of the feed screws 70 of the movement apparatuses of the guide roller 20B at both sides are made the same and the guide roller 20B is moved downward so as to make the winding angle ($\theta_1$+$\theta_2$) of the web 12 to the guide roller 20B is 15 degrees or larger. Second, the rotation amounts of the feed screws 70 of the movement apparatuses 21 at both sides of the guide roller 20B are made different, and the guide roller 20B is inclined by the predetermined angle $\alpha$ from the horizontal position so that tension variation at a side where the warp or thickness unevenness in the width direction of the web is large is made larger than the other side. Thereby, the liquid pressure variation of the coating liquid 14 in between the coating rod 28 and the web 12 can be eliminated when removing the excess of the coating liquid with the coating rod 28, and at the same time the excess coating liquid can be uniformly removed without moving the running direction of the web 12 because the winding angle of the web 12 to the guide roller 20B is 15 degrees or larger. Therefore, the thickness unevenness of the coating liquid layer in the width direction of the web can be easily made smaller when forming the coating liquid layer A on the web 12 by using the coating rod 28.

Figure 4:
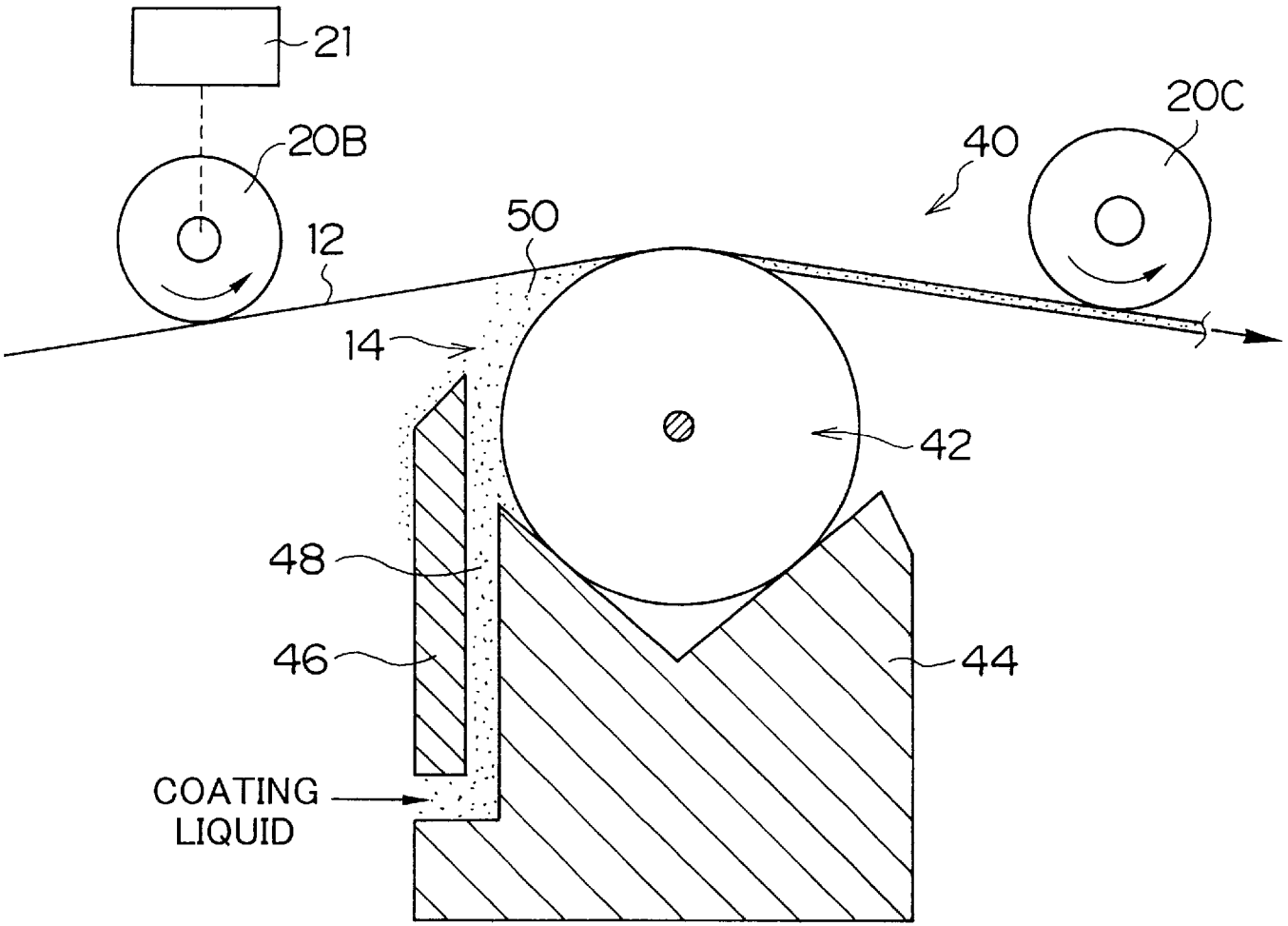
FIG. 4 is a view showing an entire structure of a rod coating apparatus of the present invention with which application and measurement are performed in the same apparatus.

FIG. 4 is a view showing an entire structure of a rod coating apparatus 40 of the present invention in another embodiment with which a coating rod 42 performing the application and measurement together is provided.

As seen from FIG. 4, the cylindrical coating rod 42 is disposed in the width direction of the web 12 in a state of coming into contact with the running web 12. The coating rod 42 can rotate in the running direction of the web 12 and at the same time is so supported on a rod support member 44 as not to block the rotation. The coating liquid 14 which is supplied to a coating liquid supply passage 48 formed with the rod support member 44 and a dam 46 forms a pool 50 at a part where the web 12 and the coating rod 42 contact with each other, and the coating liquid 14 is transferred and applied on the web 12 via the pool 50 by the rotating coating rod 42.

In a case where the rod coating apparatus 40 provided with the coating rod 42 with which the application and measurement are performed together, the movement apparatuses 21, the same as that mentioned in FIG. 2, are provided to the guide roller 20B, which is positioned at the leading side of a web transporting direction of the coating rod 42.

Accordingly, in a case of the rod coating apparatus 40 provided with the coating rod 42 with which the application and measurement are performed together, the coating liquid can be uniformly transferred and applied on the web 12 without moving the running position of the web 12. Thus, the thickness unevenness of the coating liquid layer in the width direction of the web can be easily made small when forming the coating liquid layer A on the web 12 by using the coating rod 42.

Figure 5:
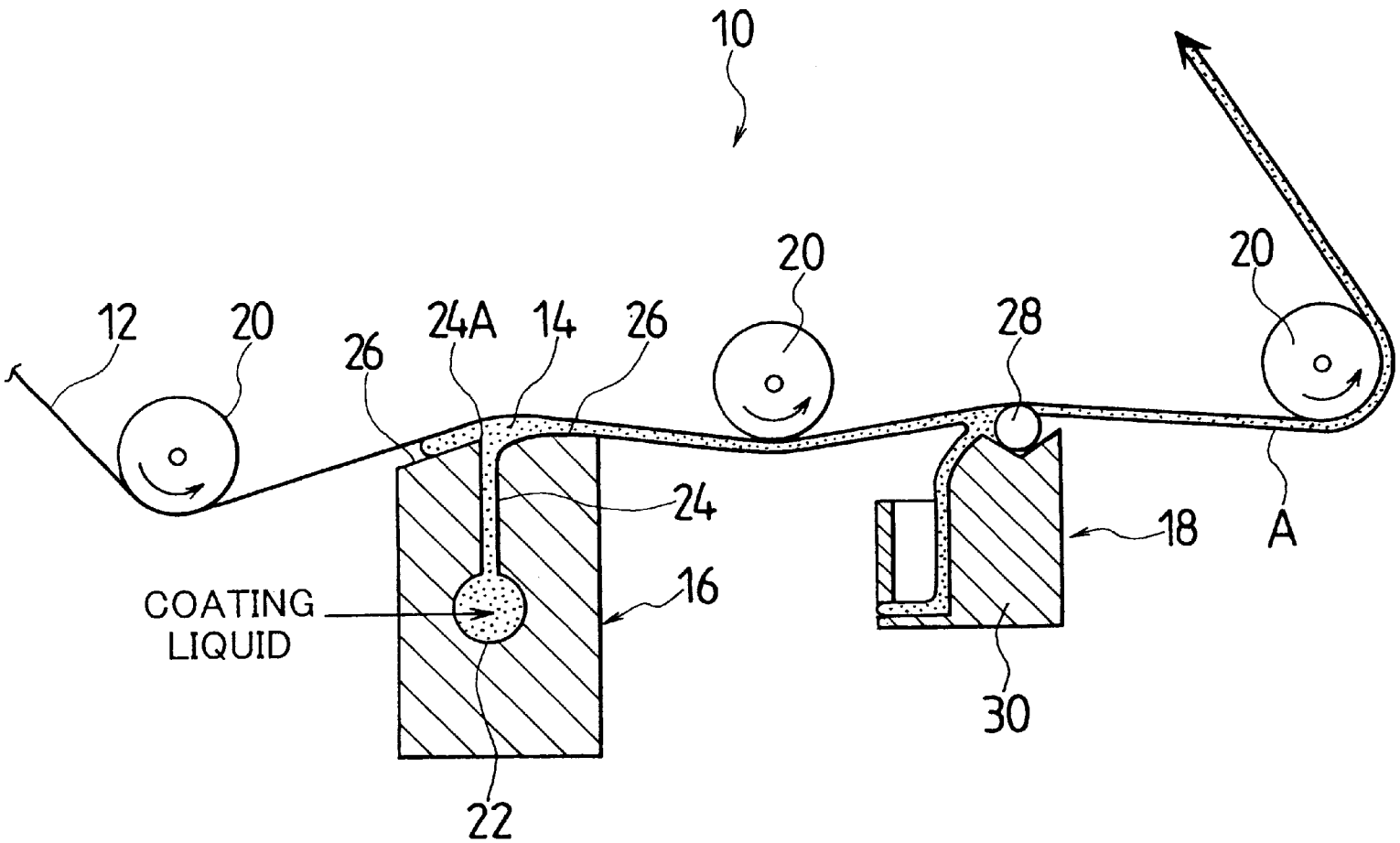
FIG. 5 is a view showing an entire structure of a rod coating apparatus of the present invention with which application and measurement are performed separately.

FIG. 5 is a view showing an entire structure of the coating apparatus 10 of the present invention with which the coating liquid excessively applied on the web by a precoating apparatus is removed by a coating rod so as to measure an amount of the coating liquid, that is, the application and measurement are performed separately.

The rod coating apparatus 10 mainly comprises the precoating apparatus 16 of an extrusion type which excessively applies the coating liquid 14 on the web 12 more than a desired amount of liquid, the coating rod apparatus 18 for removing excess of the coating liquid 14 being excessively applied on the web 12, and the plural guide rollers 20, 20, . . . provided along the web transporting passage.

The precoating apparatus 16 of an extrusion type successively extrudes the coating liquid 14 being supplied into the pocket 22 by a pressure from the outlet 24A of the slot 24 being connected with the pocket 22 onto the web 12 while pressing the head end 26 against the web 12 which is hung by the guide roller 20 and runs at a constant speed in a direction of an arrow. Thereby the coating liquid of an excessive amount is applied on the bottom face of the web 12 just in front of the coating rod apparatus 18. The type of the precoating apparatus 16 is not limited to an extrusion type; any coating apparatus which applies the coating liquid on the web may be used.

The coating rod apparatus 18 is constructed in which the flat coating rod 28 is supported by the rod support member 30, the coating rod 28 being disposed in parallel with the width direction of the web 12 which continuously runs in the running direction, and the web 12 comes in contact with the coating rod 28 at a predetermined wrap angle (winding angle) with respect to the coating rod 28 by the guide roller 20. Thus, the coating liquid layer A in a desired thickness is formed since the excess of the coating liquid 14 being excessively applied on the web 12 by the precoating apparatus 16 is removed by the coating rod 28 and is measured in a desired amount of liquid. In that case, the coating rod 28 connects with a rotation drive source (not shown) and rotates at a low speed and in a direction which is reverse to the running direction of the web 12. Alternatively, the coating rod 28 may rotate in the same direction as the running direction of the web 12 by coming in contact with the web 12, or even the coating rod 28 which does not rotate may be used.

Figure 6:
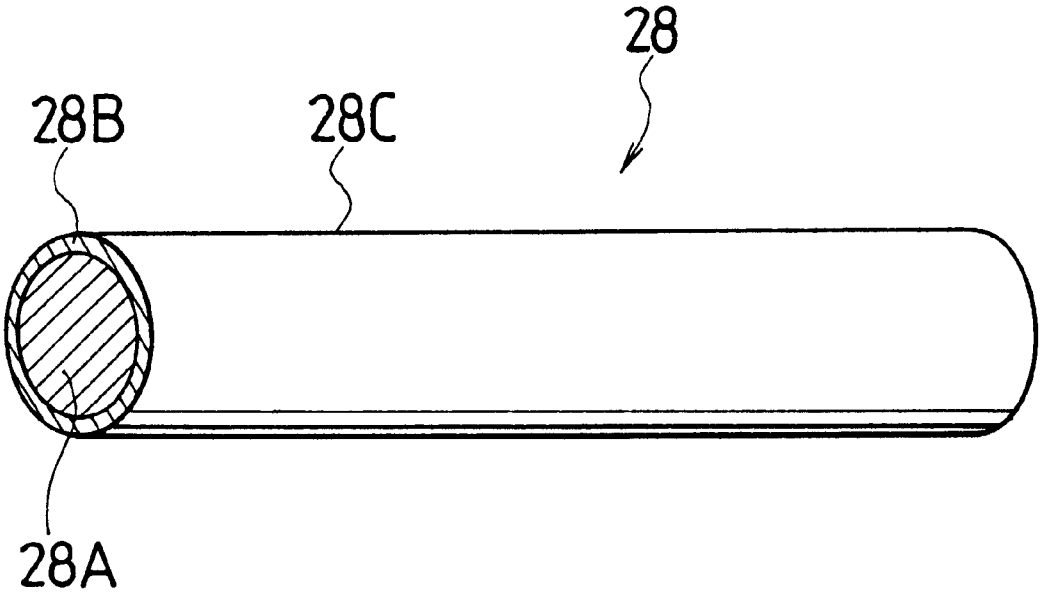
FIG. 6 is a view showing an external appearance of a flat coating rod.

As seen from FIG. 6, the coating rod 28 is formed in which hard chromium plating 28B is processed on an outer peripheral surface of a cylindrical body of a rod core 28A made of stainless steel with 1 mm to 50 mm in diameter so as to have Vickers hardness (Hv) of 1000 or more.

As described in the related art, if the flat coating rod 28 is used, foreign matters are easily caught on a rod surface 28C because the surface of the web 12 and the surface 28C of the coating rod 28 come close to each other. However, the inventors of the present invention discussed on the solution of the problem, and have discovered that a relationship between a thickness of the coating liquid layer A being formed and surface roughness of the surface 28C of the rod 28 contributes a lot on how easily the foreign matters are caught. Even the flat coating rod 28 on which the rod surface 28C is flat (and smooth) has a surface roughness on the rod surface 28C in a microscopic view; if heights of numerous projections constituting the surface roughness are too high with respect to the thickness of the coating layer A to be formed, the foreign matters are easily caught by the projections. In fact, the inventors of the present invention has also discovered that the fact how easily the foreign matters are caught depends on a degree of the maximum height of the projection among the numerous projections with respect to the thickness of the coating liquid layer A. The foreign matters are rarely caught with the projections if the maximum height of the surface roughness of the rod surface 28C is ⅓ or less of the thickness of the coating layer A being formed.

The present invention has been developed based on the above-described knowledge, with which the rod surface 28C of the flat coating rod 28 is smoothed so as to satisfy the following inequality:

$$R_{max} \leqq h/3, \tag{1}$$

where $R_{max}$ ($\mu$m) is the maximum height of the surface roughness on the rod surface, and h ($\mu$m) is thickness of the coating liquid layer A being formed.

In that case, the thickness of the coating liquid layer A being formed is a thickness ($\mu$m) of the coating liquid layer A with which the excess of the coating liquid 14 is removed by the coating rod 28, that is, after the measurement. Smoothing the rod surface 28C is performed by polishing the rod surface 28C or performing a mirror grinding to the rod surface 28C with a polishing apparatus.

Accordingly, the thickness h of the coating liquid layer A being formed and the maximum projection height $R_{max}$ of the surface roughness of the rod surface 28C are adjusted so as to satisfy the above inequality (1) and the excess of the coating liquid 14 is removed; hence the foreign matters are not easily caught on the rod surface 28C even in a case where the flat coating rod 28 is used, and thus the streaks are inhibited from occurring on the coating layer A being formed. In that case, a thickness of the coating layer A being formed is preferably 15 $\mu$m or less. This is because an allowable value (with $R_{max} \leqq h/3$) of the maximum height of the projection $R_{max}$ for satisfying the inequality (1) increases as the thickness h of the coating liquid layer A increases, and the foreign matters are more easily caught with the projection; as a result, if the thickness of the coating liquid layer A exceeds 15 μm, frequency of catching of the foreign matters is much higher.

Figure 7:
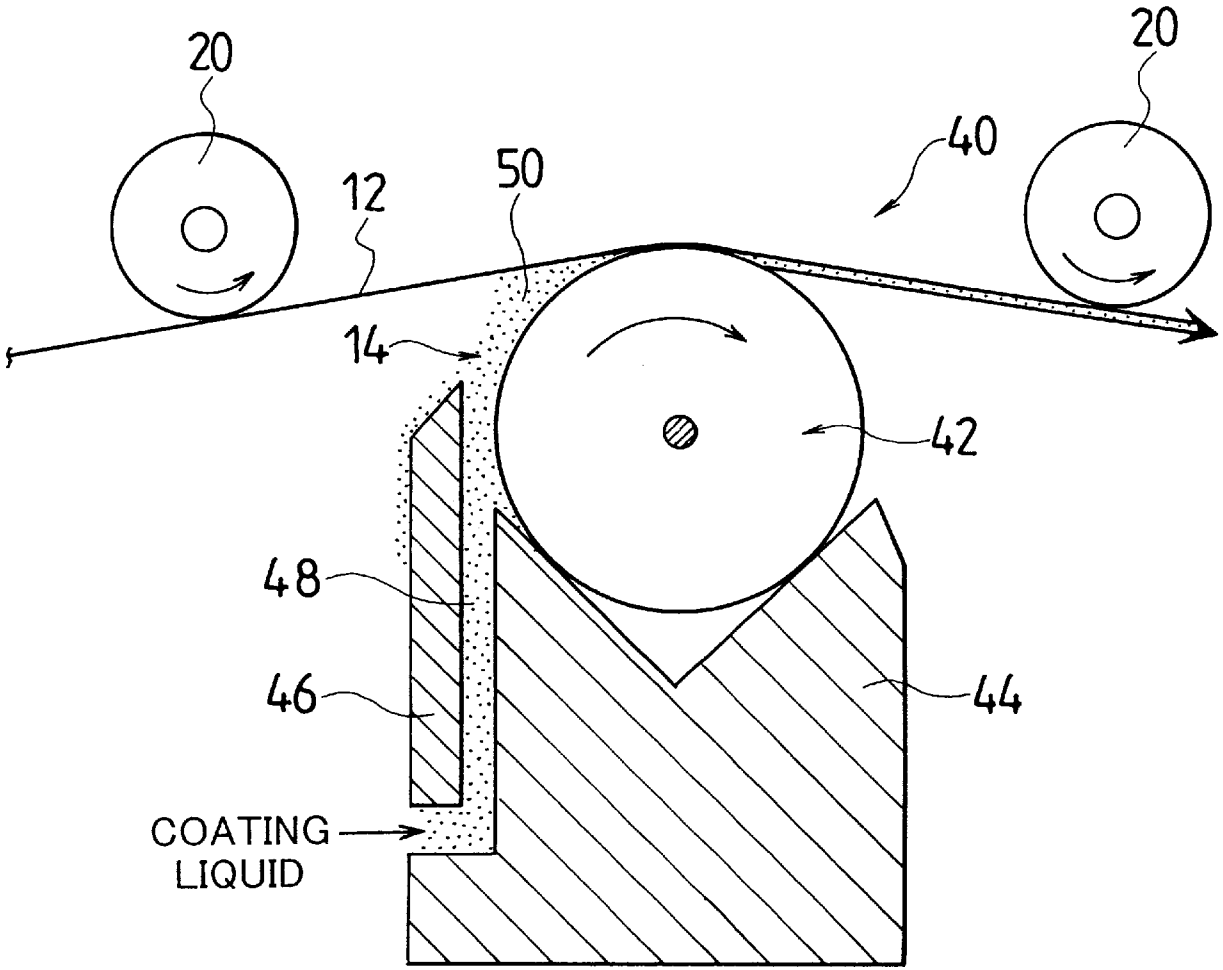
FIG. 7 is a view showing an entire structure of the rod coating apparatus of the present invention with which application and measurement are performed in the same apparatus.

FIG. 7 is a view showing the entire structure of the rod coating apparatus 40 of the present invention in yet another embodiment which uses the coating rod 42 performing the application and measurement together.

As seen from FIG. 7, the cylindrical coating rod 42 is disposed in the width direction of the web 12 in a state where it is being contacted with the running web 12. The coating rod 42 can rotate in a running direction of the web 12, and at the same time is so supported on the rod support member 44 as not to block the rotation. The coating liquid 14 supplied into a coating liquid supply passage 48 which is formed with the rod support member 44 and the dam 46 forms the pool 50 at a contact part between the web 12 and the coating rod 42, and the coating liquid 14 is transferred and applied on the web 12 via the pool 50 by the rotating rod 42.

In a rod coating apparatus 40 with the coating rod 42 by which the application and measurement are performed together, the surface of the flat coating rod 42 is smoothed so as to satisfy the inequality (1).

Thus, in the rod coating apparatus 40 with the coating rod 42 by which the application and measurement are performed together, the foreign matters are not easily caught on the rod surface, and hence the streaks are inhibited from occurring on the coating liquid layer being formed. In that case, a thickness of the coating liquid layer being formed in 15 μm or less which is same as the case with the rod coating apparatus with the coating rod by which the application and measurement are performed separately.

The typical web 12 to be used are ones with 0.3 m to 1 m in width, 45 m to 10000 m in length, and 2 μm–200 μm in thickness, and the web 12 includes a plastic film which is made of polyethylene terephthalate (PET), polyethylene-2, 6-naphthalate, cellulose diacetate, cellulose triacetate, cellulose acetate propionate, polyvinyl chloride, polyvinylidene chloride, polycarbonate, polyimide, polyamide, and so forth, or simply paper, or paper and similar material which is coated or laminated with α-polyolefin in carbon numbers 2–10 such as polyethylene, polypropylene, and ethylene-butylene copolymer; alternatively, a web may be one on which a coating layer is formed as the base material, or may even be a foil made of aluminum.

The coating liquid 14 is not limited to non-Newtonian fluid such as a coating liquid for a magnetic tape; the coating liquid may be Newtonian fluid composed with a binder of gelatin solution for a photosensitive layer which is relatively low in viscosity.

EXAMPLES

A practical experiment of the present invention was conducted by using a rod coating apparatus in which a coating rod removed excess of the coating liquid applied on a web in FIG. 1.

The coating liquid was used in which respective components in Table 1 were put in a ball mill and were sufficiently mixed and dispersed, then further mixed and dispersed uniformly after adding epoxy resin of 30 parts by weight (epoxy equivalent weight=500). The web made of PET material was used.

TABLE 1

| | |
|---|---|
| Rough Grain Carbon (average grain diameter: 300 nm) | 535 parts by weight |
| Fine Grain Carbon (average grain diameter: 20 nm) | 8 parts by weight |
| Polishing Agent | 1 part by weight |
| Nitrocellulose | 15 parts by weight |
| Urethane | 8 parts by weight |
| Hardening Agent | 110 parts by weight |
| Methyl Ethyl Ketone | 5000 parts by weight |
| Toluene | 1000 parts by weight |

FIGS. 8–10 show thickness unevenness in the width direction of the web (hereunder simply called "thickness unevenness") when changing an inclination angle of a guide roller positioned at the leading side of the running direction of the coating rod (hereunder simply called "inclination angle") and changing a winding angle of the web on the guide roller (hereunder simply called "winding angle"), and the thickness unevenness was evaluated. Moreover, presence of movement of the running position of the web (hereunder simply called "movement") was also evaluated which is indicated as the base running position in FIGS. 8 10. In that case, a coating speed over majority of the examples was 300 m/min., and a coating speed over some of the examples was 100 m/min and 800 m/min. The tension variation in the running direction of the web was 8 kgf/m in the majority of the examples, and 6 kgf/m and 15 kgf/m in some of the examples.

A criterion of the evaluation to the thickness unevenness (indicated by %) of the coating liquid layer in the width direction of the web is ±10%; the thickness unevenness of 10% or within was acceptable. Minus (−) thickness unevenness means that the thickness unevenness had an inclination which was reverse to an inclination of the plus thickness unevenness. A criterion of the evaluation to the running position of the web is as follows: "Good" means no movement from the normal running direction; "Fair" means presence of small movement from the normal running direction but not affective; and "Poor" means presence of large movement from the normal running direction and is disqualified. In the experiment, examples satisfying the conditions that "thickness unevenness" is ±10% and "movement" is "Good" and "Fair" are qualified.

FIG. 8 shows a case where a web with relatively large thickness unevenness in the width direction of the web and a wired rod were used.

With regard to "thickness unevenness" in FIG. 8, those in Examples 1, 3, and 5 were all +5, whereas those in Examples 2, 4, and 6 having tension variation in the width direction of the web by inclining the guide roller by 0.5 or 0.2 degrees were all zero.

As to "movement", in Comparative Examples 1, 2, and 3 with which the tension variation was provided in the width direction of the web by inclining the guide roller by 0.5–0.7 degrees and the winding angle at that time is 5–12 degrees, which was less than the winding angle 15 degrees of the present invention, movement of all the three examples were disqualified with all the evaluations "Poor", although "thickness unevenness" of the three examples were qualified with the values between −1 and +4.

In contrast thereto, "movement" of Examples 2, 4, and 6 in which the winding angle was 15 degrees when inclining the guide roller by 0.5 degrees was all qualified with the evaluation "Fair".

As apparent from those results, the tension variation was able to be provided in the width direction of the web without moving the running position of the web by setting the inclination angle from the horizontal position of the guide roller and setting the winding angle of the web on the guide roller at 15 degrees or larger. Therefore, the excess of the coating liquid was able to be uniformly removed since the liquid pressure of the coating liquid between the coating rod and the web was able to be made uniform.

FIG. 9 shows a case where a web with relatively small thickness unevenness in the width direction of the web was used, and a flat rod was used as a coating rod.

In Examples 7–10 in FIG. 9, "inclination angles" were 0.0, 0.05, 0.1, and 0.5 degrees and "winding angle" was 15 degrees; thus "thickness unevenness" was able to be smaller as setting "inclination angle" larger.

In Examples 11–16, "inclination angles" were 0.0, 0.05, 0.1, 0.5, 0.7, and 1.0 degrees and "winding angle" was 45 degrees; thus "thickness unevenness" was zero at a point where "inclination angle" was 0.5 degrees, and "thickness unevenness" formed a reverse inclination (−2 to −10%) at a point where "inclination angle" exceeded 0.5 degrees. Accordingly, the tendency was that "thickness unevenness" decreased as "inclination angle" was larger, but if "inclination angle" was larger even over the "inclination angle" at the point where "thickness unevenness" was zero, the result was reversed in that "thickness unevenness" increased. Consequently, setting an appropriate "inclination angle" of the guide roller based on a trend of change between "inclination angle" and "thickness unevenness" was essential.

Examples 17–20 were cases where "inclination angles" were 0.0, 0.05, 0.1, and 0.2 degrees and "winding angle" was 90 degrees; thus "thickness unevenness" was zero at a point where "inclination angle" was 0.1 degrees, and a reverse inclination (−10%) appeared as "inclination angle" exceeded 0.1 degrees. When comparing those with the cases of Examples 11–16, a larger "winding angle" affected more severely to "thickness unevenness" with a narrower "inclination angle".

Example 21 was a case where "winding angle" was set at 12 degrees, less than 15 degrees when "inclination angle" was zero; in that case, "thickness unevenness" was zero and no "movement" was present.

Examples 22–25 were cases where "inclination angle" was 0.5 degrees and "winding angle" was 45 degrees, and tension in the running direction of the web were set at three reference values: 6.0 kgf/m, 8.0 kgf/m, and 15.0 kgf/m. Moreover, a coating speed of Example 24 was 100 m/min., slower than 300 m/min. of Examples 22 and 23, and the coating speed of Example 25 was 800 m/min., which was a high-speed coating. As a result, "thickness unevenness" in Examples 22–25 was all zero, and "movement" was qualified with "Good". The fact indicated that the rod coating apparatus of the present invention was able to be applied regardless of tension in the running direction of the web and a coating speed.

Comparative Examples 4–7 were cases where the guide roller was inclined at 0.5–0.7 degrees so as to provide tension variation in the width direction of the web, and the winding angle at that time was between 10–12 degrees, which was less than 15 degrees of the present invention. In Comparative Examples, "thickness unevenness" was qualified with 0–3%, but "movement" was all "Poor" since the winding angle was less than 15 degrees.

FIG. 10 shows a case where a web with relatively large thickness unevenness in the width direction of the web was used and a flat rod was used as a coating rod. When a flat coating rod was used, the thickness unevenness in the width direction of the web affects more largely as compared with a case of using a wired rod; thus "inclination angle" had to be larger (such as 1.0 degree) so as to increase a degree of the tension variation. The examples shown in FIG. 10 thus aimed at studying changes of "thickness unevenness" and "movement" in that case.

In Examples 26–32 of FIG. 10, "thickness unevenness" and "movement" were studied by making variety of combinations between a coating speed, tension in the width direction of the web, and "winding angle", while setting "inclination angle" constantly at 1.0 degrees. As a result, "thickness unevenness" was all qualified with the range between −7 to +10%, and "movement" was all qualified from "Fair" (Example 1 only) to "Good". Although "inclination angle" was relatively large such as 1.0, the rod coating method of the present invention was still able to be applied regardless of tension in the running direction of the web and a coating speed.

Comparative Examples 8–18 were cases where a web with relatively large thickness unevenness in the width direction of the web was used and a flat rod was used as a coating rod. In those examples, studies were conducted as to what extent "thickness unevenness" was eliminated when "inclination angle" was small, and on the other hand how "movement" did change as "inclination angle" was set larger in order to eliminate "thickness unevenness".

As a result, in Comparative Examples 8–14 where "inclination angle" was changed between 0.0–0.5 degrees and "winding angle" was changed between 8–10 degrees, "inclination angle" was all qualified; however, "thickness unevenness" was between 15–20% and thus was all disqualified because "inclination angle" was insufficient.

In Comparative Examples 15–18 where "inclination angle" was changed between 1.0–2.0 degrees and "winding angle" was changed between 8–10 degrees, "thickness unevenness" fell within a qualified range of between 5–10%, but "movement" was all disqualified because "winding angle" was insufficient.

As revealed from FIG. 10, in a case where a flat rod was used as a coating rod, appropriately setting an inclination angle from the horizontal position of the guide roller while setting the winding angle or the web on the guide roller at 15 degrees or larger were particularly crucial, because the thickness unevenness of the coating liquid layer in the width direction of the web tended to be largely affected by the thickness unevenness in the width direction of the web itself.

Another set of practical experiments were conducted by using a rod coating apparatus in FIG. 5 which removed excess of coating liquid applied on the web by a flat coating rod.

The coating liquid was used in which respective components in Table 1 were put in a ball mill and were sufficiently mixed and dispersed, then further mixed and dispersed uniformly after adding epoxy resin of 30 parts by weight (epoxy equivalent weight=500). The web made of PET material was used.

Table 2 shows conditions and results of the practical experiments.

A measurement apparatus for measuring the maximum height of a projection $R_{max}$ was the Surfcoder SEF-30D made by Kosaka Research Institute.

TABLE 2

| | Coating speed (m/min) | Thickness h of coating film (μm) | Maximum height $R_{max}$ of projection (μm) | h/3 (μm) | Presence of streaks on coating liquid layer |
|---|---|---|---|---|---|
| Example 33 | 300 | 6.1 | 0.2 | 2.03 | No |
| Example 34 | 300 | 6.1 | 1.0 | 2.03 | No |
| Example 35 | 300 | 6.1 | 2.0 | 2.03 | No |
| Example 36 | 300 | 1.2 | 0.4 | 0.40 | No |
| Example 37 | 300 | 15.0 | 3.0 | 5.00 | No |
| Example 38 | 300 | 15.0 | 5.0 | 5.00 | No |
| Example 39 | 100 | 6.1 | 2.0 | 2.03 | No |
| Comparative Ex. 19 | 300 | 6.1 | 2.5 | 2.03 | Yes |
| Comparative Ex. 20 | 300 | 1.2 | 0.5 | 0.40 | Yes |
| Comparative Ex. 21 | 300 | 15.0 | 6.0 | 5.00 | Yes |

Examples 33–39 in Table 2 were cases where the inequality $R_{max} \leqq h/3$ was satisfied, and Comparative Examples were cases where $R_{max} \leqq h/3$ was not satisfied, as seen from a comparison between the maximum height of the projection $R_{max}$ (μm) and h/3 (μm).

As a result, a satisfactory product was able to be obtained without the streaks on the coating liquid layer being formed. Example 39 was a case where the thickness of the coating liquid layer h and the maximum height of the projection $R_{max}$ were set at the same values as the Example 35, and the coating speed was decreased from 300 m/min to 100 m/min; however the streaks were still not recognized on the coating liquid layer.

In contrast, products in Comparative Examples 19–21 were all disqualified due to occurrence of the streaks on the coating liquid layer being formed.

As described hereinabove, according to the rod coating method and apparatus of the present invention, the thickness unevenness of the coating liquid layer in the width direction of the web can be easily made smaller when forming a coating liquid layer on the web by using the coating rod.

Also as described above, since the rod coating method and apparatus of the present invention inhibits the foreign matters to be caught on the rod surface when forming a coating liquid layer with a desired thickness on the web by using the flat coating rod, which is superior in resisting abrasion. Therefore, the streaks can be inhibited from occurring on the coating liquid layer.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A rod coating method for forming, with a coating rod, a coating liquid layer on a running web tensioned by a plurality of guide rollers, wherein:

a precoating apparatus excessively applies a coating liquid on the web and the coating rod adjusts an amount of the coating liquid on the web by removing an excess of the coating liquid on the web; and the web has a tension variation in a width direction of the web to adjust a thickness unevenness of the coating liquid layer in the width direction of the web.

2. The rod coating method as defined in claim 1, wherein one of the plurality of guide rollers adjacent to the coating rod is moved to give the tension variation to the web.

3. The rod coating method as defined in claim 2, wherein a winding angle of the web with respect to the one of the plurality of guide rollers is at least 15 degrees.

4. The rod coating method as defined in claim 2, wherein the one of the plurality of guide rollers is moved vertically and an axis of the one of the plurality of guide rollers is inclined with respect to a horizon.

5. The rod coating method as defined in claim 4, wherein a winding angle of the web with respect to the one of the plurality of guide rollers is at least 15 degrees.

6. A rod coating method for forming, with a coating rod, a coating liquid layer on a running web tensioned by a plurality of guide rollers, wherein:

a precoating apparatus excessively applies a coating liquid on the web and the coating rod adjusts an amount of the coating liquid on the web by removing an excess of the coating liquid on the web;

the web has a tension variation in a width direction of the web to adjust a thickness unevenness of the coating liquid layer in the width direction of the web; and wherein a winding angle of the web with respect to the one of the plurality of guide rollers is at least 15 degrees.

* * * * *